United States Patent [19]

Pazar

[11] Patent Number: 4,534,302

[45] Date of Patent: Aug. 13, 1985

[54] APPARATUS FOR BURNING BALES OF TRASH

[76] Inventor: Charles A. Pazar, 98 E. Saddle River Rd., Saddle River, N.J. 07458

[21] Appl. No.: 578,649

[22] Filed: Feb. 9, 1984

Related U.S. Application Data

[63] Continuation-in-part of Ser. No. 264,515, May 18, 1981, abandoned, Ser. No. 415,957, Sep. 8, 1982, abandoned, and Ser. No. 415,786, Sep. 8, 1982, abandoned.

[51] Int. Cl.[3] ..... F23G 5/10

[52] U.S. Cl. ..... 110/346; 110/220; 110/255; 110/257; 110/228

[58] Field of Search ..... 110/223, 224, 220, 221, 110/219, 226, 228, 232, 238, 248, 251, 255, 256, 257, 289, 290, 299, 300, 313, 323, 346, 196

[56] References Cited

U.S. PATENT DOCUMENTS

| | | | |
|---|---|---|---|
| 1,338,694 | 5/1920 | Peebles | 110/300 |
| 2,026,969 | 1/1936 | Flynn | 110/220 |
| 2,269,273 | 1/1942 | Krogh et al. | 110/228 |
| 2,441,366 | 5/1948 | Mosshart | 110/289 X |
| 2,912,941 | 11/1959 | Hughes et al. | 110/255 X |
| 2,978,997 | 4/1961 | Pierce | 110/257 |
| 3,509,836 | 5/1970 | Perry | 110/346 |
| 3,556,025 | 1/1971 | Holley | 110/257 |
| 3,570,421 | 3/1971 | Flowers, Jr. | 110/255 |
| 3,707,355 | 12/1972 | Anderson | 110/257 |
| 3,708,078 | 1/1973 | Clements . | |
| 3,722,433 | 3/1973 | Kramer | 110/255 |
| 3,749,031 | 7/1973 | Burden, Jr. | 110/213 |
| 3,791,316 | 2/1974 | Sigg | 110/257 |

(List continued on next page.)

FOREIGN PATENT DOCUMENTS

| | | | |
|---|---|---|---|
| 38962 | 11/1981 | European Pat. Off. | 110/196 |
| 2001013 | 1/1970 | Fed. Rep. of Germany | 110/228 |
| 2933786 | 3/1981 | Fed. Rep. of Germany | 110/196 |
| 3020798 | 12/1981 | Fed. Rep. of Germany | 110/196 |
| 123271 | 9/1979 | Japan | 110/289 |
| 20916 | 2/1981 | Japan | 110/118 |
| 2067729 | 7/1981 | United Kingdom | 110/346 |

OTHER PUBLICATIONS

Selco Products, Inc., advertisement–p. 47, from "Waste Age", Dec. 1981.

AMBACO advertisement–p. 10 from "Waste Age", Dec. 1981.

"New Linear Polymers", by Lee, Stoffey & Neville.

*Primary Examiner*—Henry C. Yuen

*Attorney, Agent, or Firm*—William D. Hall

[57] ABSTRACT

Bales of combustible trash made to specific specifications are burned in a furnace having two parallel upright sidewalls between which the bales pass during burning. A horizontal grate extends between the sidewalls. The bales, if remotely made from the furnace, are bound by an easily meltable strap. The length of the bale is measurably smaller than the distance between said sidewalls to accurately accommodate springback. A ram, after compacting the waste in segmental fashion, pushes each bale to a position between said sidewalls; with the length of the bale being perpendicular to the sidewalls, so that a bale enters the furnace. Springback following the melting of straps allows the bale to expand to fill the gap between the sidewalls. This facilitates ignition and/or burning of the bales and provides a seal against furnace sidewalls. When the ram feeds a fresh bale, previously charged bales (consumed proportional to time in the furnace) are advanced toward the ash discharge port. Before the bales are formed, the trash may be optionally dried by using heated air in the classification into "light" sort and "heavy" sort. The "light" sort is baled and burned as described above. The "heavy" sort or a part of the light sort may be premixed with noxious liquid or solid wastes before charging to the furnace. Temperatures consistent with economical use of refractory (1500° F. to 1700° F.) are maintained, for a limited area adjacent the inner wall of the furnace, by addition of liquid water, while interior temperatures of the furnace of about 3000° F. prevail in the central portion of the furnace necessary for the incineration of noxious wastes.

28 Claims, 12 Drawing Figures

U.S. PATENT DOCUMENTS

| | | | |
|---|---|---|---|
| 3,791,317 | 2/1974 | Schrage et al. | 110/223 |
| 3,837,302 | 9/1974 | Bersier . | |
| 3,841,242 | 10/1974 | Sigg | 110/257 |
| 3,855,950 | 12/1974 | Hughes et al. | 110/255 |
| 3,882,803 | 5/1975 | Anderson et al. | 110/109 X |
| 3,955,512 | 5/1976 | Martin et al. | 110/255 |
| 3,965,362 | 6/1976 | Harvey | 110/251 |
| 4,015,546 | 4/1977 | Paules . | |
| 4,029,026 | 6/1977 | Normantas | 110/109 X |
| 4,098,200 | 7/1978 | Dauvergne | 110/228 |
| 4,172,425 | 10/1979 | Sheridan | 110/257 |
| 4,177,723 | 12/1979 | Buchele et al. . | |
| 4,178,232 | 12/1979 | Nollet | 209/3 |
| 4,256,032 | 3/1981 | Davis . | |
| 4,266,900 | 5/1981 | Rynyk | 110/255 X |
| 4,273,073 | 6/1981 | Robinson | 110/245 |
| 4,300,459 | 11/1981 | Borio et al. | 110/263 |
| 4,326,470 | 4/1982 | Maranhao | 110/220 |
| 4,385,567 | 5/1983 | Voss | 110/257 |

APPARATUS FOR BURNING BALES OF TRASH

RELATED APPLICATIONS

This application is a continuation-in-part of my prior three copending applications: (1) Ser. No. 264,515, abandoned filed May 18, 1981, entitled Method of and Apparatus for Burning Bales of Trash; (2) Ser. No. 415,957, filed Sept. 8, 1982, abandoned, entitled Method of Burning Bales of Trash; and (3) Ser. No. 415,786, filed Sept. 8, 1982, abandoned entitled Apparatus for Burning Bales of Trash.

BACKGROUND

In an effort to recover the heat content of municipal solid waste (SW), the SW is processed to a product for burning with coal in steam raising power boilers, or burning alone in power boilers for steam and/or electricity generation. Two principal products from SW are prepared for this purpose: (i) shredded "light sort", pieces 4" to 6" in size, and (ii) extruded product, ½" to 2" in diameter, about 2" long. These are then fed to boilers.

To make these products it is necessary to shred the SW using one shredder, or better two in series, shredding everything from the garbage truck with the exception of white goods (refrigerators, etc.) and demolition debris (cinder blocks, etc.). This procedure was found through hard experience to have two drawbacks: (i) explosions within the shredder as the high speed hammers hit sticks of dynamite, artillery shells and land mines, etc.; (ii) high boiler ash content due to fragmenting of glass (up to 10% by weight of SW) by the high speed hammers of the shredders, the glass pieces being embedded in the paper of the shredded or extruded product. Understandably this proved undesirable due to increased ash burden on the boilers.

Recognizing these disadvantages, the step of trommeling, before shredding, was advanced. The trommel is a rotating drum, say 10 feet in diameter and 20 feet long of steel plate with about 4" diameter holes in sidewalls, with lifting bars inside, rotating at low speed. The SW, fed into this trommel, which is mounted at a small angle to the horizontal, is dispersed, carried up the sidewalls by lifters and dropped back to the bottom of the drum. Everything possible falling through the holes will pass through. This includes the greatest percent of glass items (intact), tin cans (ferrous) and like heavy items as well as some small loose pieces of paper and plastic. The lifting-dropping action inside the trommel serves to break and disperse bags of refuse as well as boxed refuse.

Separation of glass and tin cans within the trommel is aided by prompt and rapid removal of paper, corrugated board and plastic film from the machine which together will be about 50% of the weight of trommel charge. This is done conveniently by blowing air countercurrently and at predetermined and relatively high velocities through the interior of the trommel. The air currents lift out and convey paper, corrugated material, plastic film and leaves, dust and such light components of the SW. Through introduction of this air current, "light sort" is lifted out and separated from the mass of SW.

In installations using this system, the solids of the "light sort" such as paper, plastic films, etc., are separated from the conveying air in a large diameter dry cyclone. The cyclone is a vertically mounted cone with a cylinder of maximum cone diameter mounted on top. The cone/cylinder is arranged with apex or bottom of converging sidewalls looking down. Use of the trommel as here described greatly reduces or eliminates the frequency of explosions. Also, less power is used in shredding of the "light" sort. Additionally, the fuel product recovered has reduced ash, due to lower glass content. It is used in this invention to separate the air conveyed fraction "light sort" from the "heavy" sort, that falls through.

The working of the invention will be set forth in the following description. It will be readily apparent to one skilled in the art that well known art may be substituted for one or more of the parts herein shown, while substitution will not be grounds for negation.

DETAILED DESCRIPTION OF THE DRAWINGS

Figure 1:
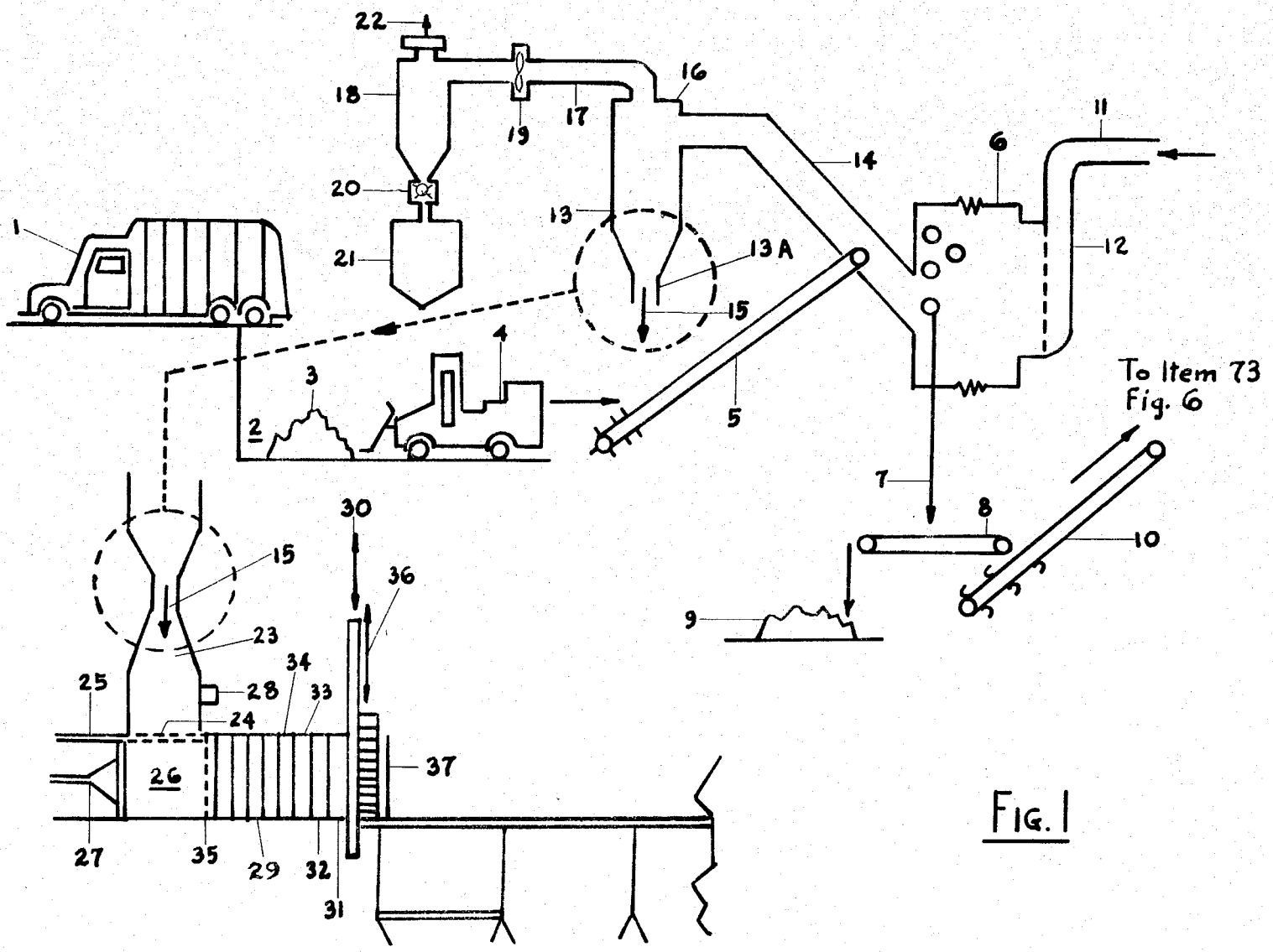
FIG. 1 is a schematic of processing of waste from receipt (tipping) to charging of furnace.

In FIG. 1, there is shown the receiving of waste by truck 1, which truck empties into a receiving pit 2, forming a pile of waste 3.

This waste in pile 3 is sorted by discarding demolition waste and white goods (refrigerators, appliances) by the operator of front end loader 4, who in addition loads pre-sorted waste, after removal of demolition wastes and white goods, onto steel, cleated conveyor 5. The rate of charging of conveyor 5 is fixed to equal the combustion rate of the furnace.

Conveyor 5 will generally be mounted to vertically lift conveyed waste out of the receiving pit to the entrance, charging port of trommel 6, which may be elevated a good distance above the receiving pit 2.

The trommel 6 may be any of several configurations commercially available, including those cylindrical or slightly conical in cross-section. Of steel plate construction and fitted out with lifting bars, each trommel design incorporates closely spaced holes or apertures in the sidewalls of 4" to 6" diameter. The trommel is rotated around its long axis, at low rpm in the range of ½ to 5 rpm. The trommel 6 may be mounted so that its long axis is at a slight angle to the horizontal. Dimensionally, trommel 6 may be 6" to 15" in diameter and may have a length of 1½ to 3 times its diameter, dimensioned according to the required tons per day of waste throughout.

With rotation of the trommel 6, "heavy sort" comprising the glass and ferrous fraction of the solid waste together with stones, bric-a-brac and like materials 7 fall through the holes of the trommel's sidewalls onto moving steel, cleated conveyor 8. In one embodiment of this invention, the "heavy sort" 7 may be discarded to landfill. In that case, the heavy sort 7, on conveyor 8, will unload onto pile 9, for truck transport to land-fill using front-end loader 4 of similar loading machine well-known in the art.

Figure 6:
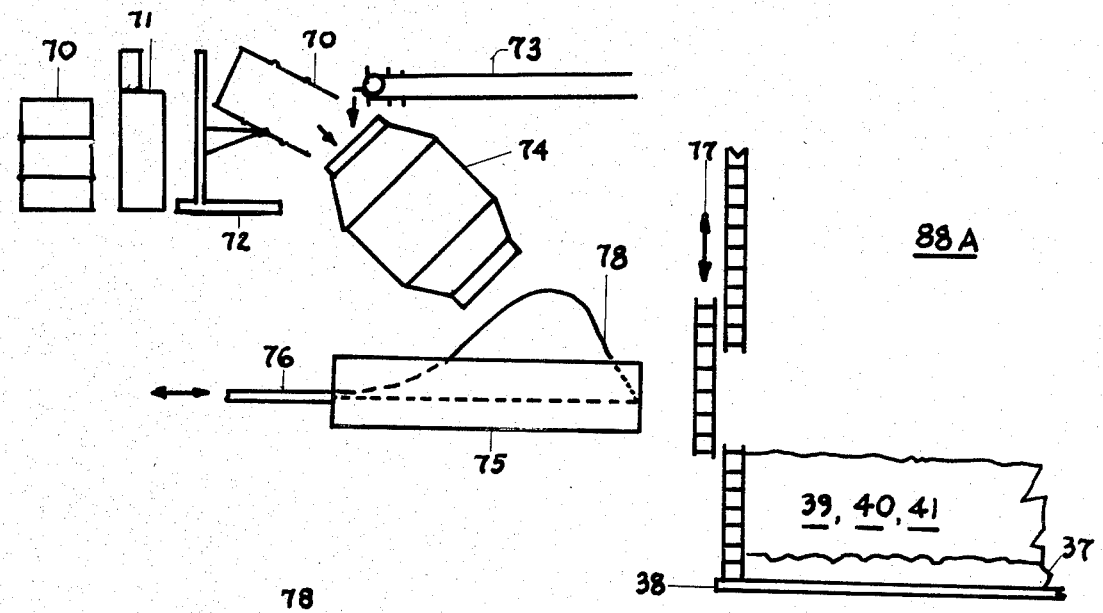
FIG. 6 is a schematic showing the mixing of noxious wastes and manner of charging to the furnace.

In another embodiment of this invention, the heavy sort is incinerated. In that event lifting to furnace side or roof charging port might be required which would be carried out by bucket lifting conveyor 10, for heavy sort 7, which meshes with conveyor 73 to concrete mixer 74 (FIG. 6).

Preheated air 11 obtained by mixing hot furnace exhaust gas (via pipe 11 of FIG. 2) with ambient air (via blower 11A and valve 12A of FIG. 2), the resulting mixture at temperatures less than 500° F., is introduced under pressure into manifold 12 of trommel 6. Manifold 12 serves to distribute said pressurized air, countercurrently into trommel 6, lifting out and conveying to cyclonic separator 13, via duct 14, all particles capable of lift out such as pieces of paper, plastic film, corrugated board and leaves, which materials are here designated "light sort" 15.

The purpose of using preheated air via pipe 11 in trommel 6 is to improve heat economy of the operation by employing waste heat of the exhaust gas from the furnace for drying of "light sort" 15. This is an optional embodiment of the present invention, it being recognized that satisfactory operation of the system of the invention will occur without the use of pre-heated air from pipe 11 in the operation of trommel 6 in the majority of applications.

Trommel 6, also called sorter, is built according to U.S. Pat. No. 4,178,232 to Anthony R. Nollet, issued Dec. 11, 1979, for "Apparatus for Separating Solid Materials". This patent shows a conveyor 36 in its FIG. 1 which corresponds to the conveyor 5 of this application.

Air classifier or trommel 6 corresponds to drum 14 of said Nollet patent. Hot air from pipe 11 under pressure, and at high velocity, is fed into the open end of the rotary drum air classifier 6 via manifold 12. The blast of hot air from pipe 11 carries the "light sort", such as paper, via outlet pipe 14 into chamber 13 where the "light sort" falls through outlet 13A while the hot air with "fines" passes out passageway 17.

In other words, the partially dried light sort, after conveyance in duct 16, is admitted into cyclonic separator 13. Under the centrifugal forces within the cyclonic separator 13, aided by tangential entrance of feeder duct work 14, the "light sort" is thrown to the outer walls and makes its way to the bottom discharge 13A. Conveying air, with "fines" freed from "light sort" particles makes its way from bottom to top around vertical centerline of cyclonic separator 13, discharging at top center port 16, into transfer duct 17 to air cleanup cyclone 18.

Figure 2:
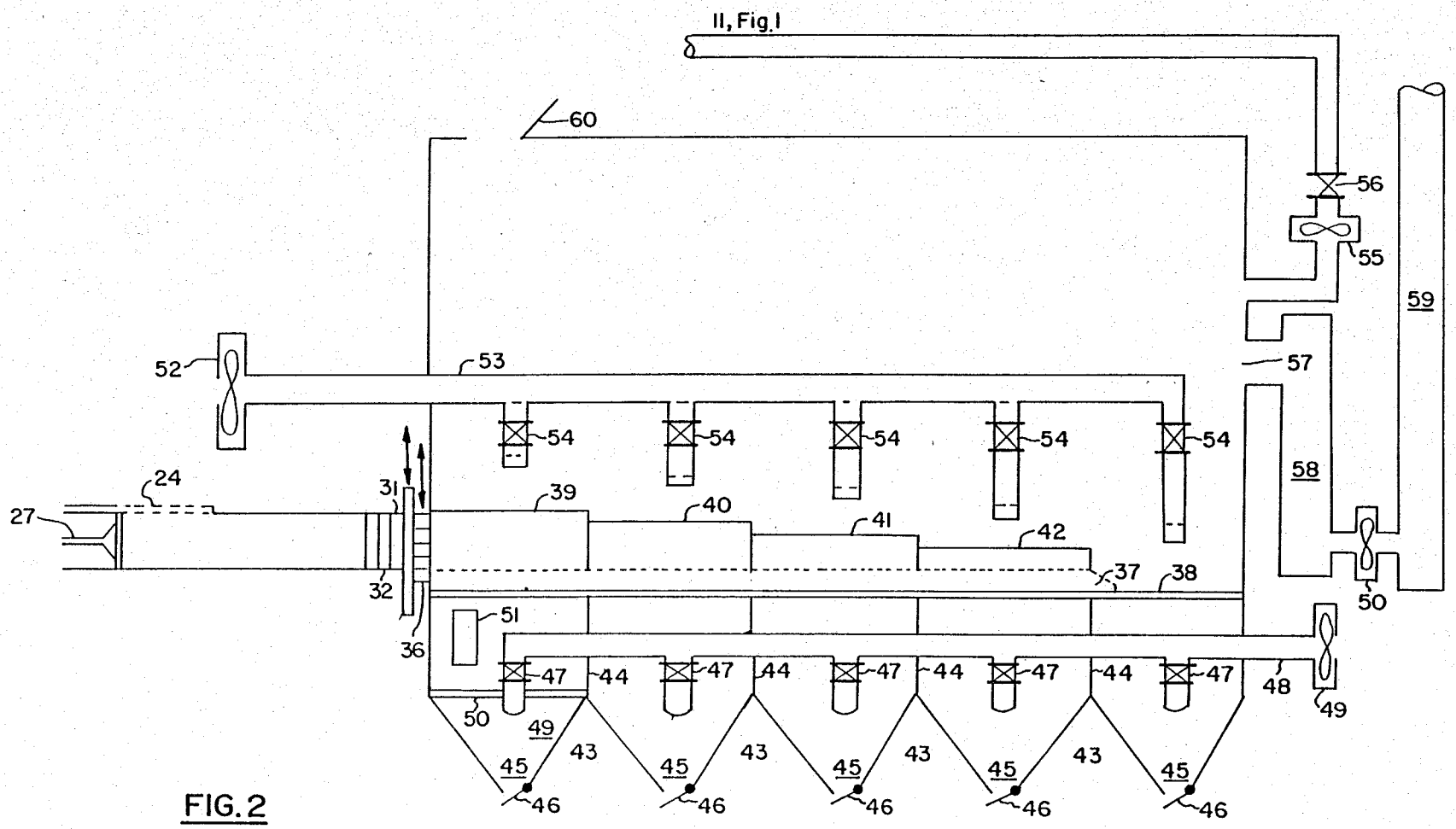
FIG. 2 is a longitudinal view of the furnace and arrangement of ram used for both baling "light sort" and for feeding of furnace.

The "light sort" leaving outlet 13A corresponds to the trash 4 fed from sorter 52 (FIG. 7) into baling device 25, 26, 27 (FIG. 1). The "light sort" is then baled. When baled remotely from the furnace meltable straps are applied 67A (FIG. 4) before the bales are fed into the furnace 36, etc. (FIGS. 1 and 2).

Air cleanup cyclone 18 (FIG. 1) is used to remove dust from the gas-stream discharged from cyclonic separator 13. In certain circumstances, to achieve fine particle separation from this stream an auxiliary fan 19 may be required to attain necessary pressure drop to achieve requisite cleanup of fine dust particles in cyclone 18. Cyclone 18 separates dust through centrifugal action wherein the dust is thrown to the converging sidewalls, making its way to bottom discharge through rotary valve 20 into dust receiving chamber 21. Cleaned air follows the well known spiral path centered on vertical central axis of the cyclone, from bottom to top, discharging at top-center to atmosphere 22.

This invention entails the combustion of pre-formed bales or fuel blocks of "light sort" and optionally of both "light" and "heavy sort" or sorted waste in which appliances (refrigerators, etc.) and demolition debris have been sorted out of specified density, height, width and length. As previously noted, the use of heated air in operation of the trommel 6 is optional and merely one embodiment of the present invention. It will then be obvious that the formation of the bales/fuel-blocks may be carried out at any distance from the furnace in which burned. When bales/fuel-blocks are made away from the furnace, they are bound with burnable or meltable binding straps 67A (FIG. 4) to retain structural integrity of the bales/fuel-blocks during handling and transport.

Figure 4:
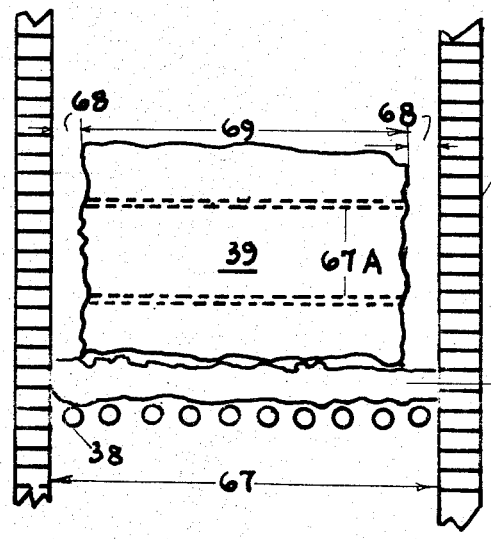
FIG. 4 is a transverse section, parallel to face of ram, through furnace, immediately upon completion of charging of new bale into preheated furnace or furnace at operating temperature.

When the light sort trash is baled at a distance from the furnace, a conventional baling machine is used. The bales are then secured by meltable straps 67A (FIG. 4). These straps are of a material which is not injured by temperatures prevailing outside the furnace, but quickly melt under furnace heat.

Where a meltable strap around the bale is specified, a plastic strip "Avistrap" manufactured by Food Machinery Corp. (FMC) may be used. The same end result but at slightly longer time interval is possible using a burnable binding means such as rope of cotton, sisal, hemp, etc. (organic material). Other possible materials are set forth in the text New linear Polymers, by Lee, Stoffey and Neville (1967), published by McGraw-Hill, Inc., Library of Congress Catalog Card No. 67-15859. The strap or rope may be applied by hand or by an automatic baling machine. Suitable baling machines include AMBACO NSB-350, manufactured by American Baler Co., HL-50 or HLO-72, or HLO-60E manufactured by Selco Products, Inc., and the baling machines shown in U.S. Pat. No. 4,177,723 to Buchele and U.S. Pat. No. 4,256,037 to Davis.

The present disclosure will describe the making of fuel blocks/bales close to the furnace inasmuch as a beneficial second employment of the baling machinery is thereby gained.

Light sort 15 from output 13A of sorter 6 (FIG. 1) is collected in bin/charging hopper 23 equipped with retractable bottom plate 24 (FIG. 1). While the several steps of loading and compression may be, with equal result, manually controlled, an automatic operation using well known electronic, mechanical or hydraulic controls will be here shown. On signal from photoelectric device 28, or alternatively from load cells yielding signal of pre-set and required weight or volume collected in bin/charging hopper 23, and with the additional easily programmed requirement that baling charge space 26 is empty, retractable bottom plate 24 is withdrawn to position 25 by readily available mechanical or hydraulic drives, dropping a pre-fixed and known amount of "light sort" from bin/charging hopper 23, to bailing machine charge space 26. Ram 27 exerts 10 to 100 psi pressure on the trash, and compresses light sort to a density range of 10 to 20 lbs. per cubic foot (that is, one cubic foot of compressed "light sort" will weigh 10 to 20 pounds). The ram 27 is driven within the chamber of rectangular cross-section, the roof of which chamber is identified as 29. On signal showing that retractable back-up plate 30 is in lowered position and with a signal that baling machine charge space 26 has a charge of light sort therein, ram 27 is caused to advance, compressing the contents of the charge space to a small fraction of the charge space volume 31.

The sequence of filling of charge volume 26 and compression to compacted segments is shown by successive segments 32, 33 and 34. Segments are added until required width (with width being understood to comprise all segments from 31 to 34), being attained, said width being fixed by structural considerations, furnace loading (tons per day), length of furnace and time required for complete combustion of the bale/fuel block.

It will be apparent that the bale/fuel block made according to the before given procedure illustrated in FIG. 1 requires repeated operation of the ram forming segments 31, 32, 33 before charging to the furnace. Also the bale/fuel block will have gross strata orientation, predominantly vertical as shown by direction and orientation of segments 31 to 34 inclusive. However, due to the diverse configuration of the particles of "light sort" making up each segment, a stratification at right angles to segments 31 to 34 must also exist. The stratification in each case is significant as it governs the openings and passages which together constitute conduits bringing air and oxygen to points of combustion as well as conduits for carry-away of the products of combustion.

While the bale/fuel-block will show good combustion in either stratification alignment, a preferred alignment corresponding to that of least pressure drop of combustion air through the block is preferred which may be attained by rotating the bale/fuel-block 90°, from orientation shown in FIG. 1 before charging to the furnace by a suitable mechanical device not shown. Such rotation would most probably be beneficial when the compacting ram works in the vertical plane, rather than in the horizontal as shown in FIG. 1.

Ram 27 having built up the required number of segments 31–34 is retracted back from segment 34 a short distance, to position 35, back-up plate 30 is lifted a distance equal or greater than top plate 29, and at the same time guillotine furnace charging gate 36 is raised to a distance equal or greater than top plate 29. Immediately that these two plates are lifted, ram 27, its face having previously been withdrawn to 35, is driven forward stopping when the face of the ram reaches plane 37, and the cycle of feeding of "light sort" 15 into bale machine receiving hopper 23 and forming of segments 31, 32 and so forth as noted above is repeated.

It will be readily apparent that there is a distinctly two-fold function and sequence to the operations of ram 27. The first function is that of compression of "light sort" into compressed segments and repetition of this compression stroke a sufficient number of times to build up the bale/fuel-block to its required width. The second function of ram 27 is to charge the furnace with the completed bale/fuel-block. In the first function the movement of the ram is confined to the distance 34 to 31 of FIG. 1. In the second function ram movement travels from plane designated 35 to the plane shown as 37.

While ram feeding of furnaces is shown in other patents, the distinct two functions for the ram, above outlined, is not shown in any of the prior patents so far as known.

FIG. 2 shows a longitudinal section through the furnace, the connection with FIG. 1 made clear through use of the same notation of guillotine charging gate 36, and ram 27. Fuel block/bales designated 31, 32, 33 and 34 on FIG. 1, may, with suitable arrangement of retractable bottom plate not shown, be positioned on a layer of ferrous scrap 37, which in turn is supported by grates 38. In one embodiment of this invention the fuel block-/bales are positioned upon a layer, approximately 12" thick of ferrous scrap, magnetically separated from ash-residue. This layer of scrap steel is placed directly on the grate and below bales. The purpose of this layer is to trap liquid glass and low melting point metals, before reaching the grates. Were this molten material free to reach the cooler grates, blockage of air passages by congealed glass and metal masses may be expected. The grates are shown in FIG. 2 as in fixed position. They are horizontally mounted and may be made of pipe or bar stock. The grates have no up-looking projections permitting smooth low friction advance of fresh bale/fuel-block while advancing previously charged bales the length of the fuel block.

Fuel blocks, of reduced height due to increasing length of time in the furnace are designated 39, 40, 41 and 42, it being apparent that the shorter fuel blocks 42 and 41 have been retained longer in the furnace than 40 and 39. Generally an overall time of about 1 hour, which may be shortened to ½ hour or lengthened to 1½ hours, by adjustment of underfire air rates, is allowed for incineration of the bale/fuel block. Referring to FIG. 2, at the 1-hour retention time, bale 39 was charged 15 minutes after bale 40 which in turn was loaded into furnace 15 minutes after 41, etc.

The height of the bales/fuel blocks fed into the furnace shall be 12" minimum and may reach 60". Height of bale/fuel block is defined measured vertically at right angles to the grate. Width of the bale/fuel block is defined as inside to inside of furnace's sidewalls less linear measurement of springback. This will range from 1'-0" to over 20 feet. Length of the bale/fuel block is defined as parallel to line of grates and will range from 1 foot to 18 feet. While natural draft from conventionally sized stakes will provide sufficient underfire combustion air at the pressure drops found within the before-given heights, forced draft may optionally be used to increase combustion rate. In either case it will be immediately apparent that the pressure drop through the fuel block-/bale will be greater at 39 than at 41. Toward regulating air flow to the different pressure drops encountered, underfire-air plenums 43 are provided, through use of transverse support walls 44, each provided with ash- /residue hopper 45, and with a bottom discharge gate 46 providing collection, storage and discharge for ash-/residue from combustion in the space above.

Underfire air for combustion is pressured by fan/-blower 49 and conveyed by duct 48 to plenums 49 and 43. Adjustment of air supply which varies from plenum to plenum is made by dampers 47. Plenum 49 is located under the last charged bale and will require the highest pressure due to maximum pressure drop of the overlying bale. The pressure in plenum 43 under bale 42 will be less than the pressure in the plenum beneath bale 41, etc. Each plenum is fitted at its bottom with a gate discharge for ash 46; plenum 45A showing the highest ash discharge.

Plenum 49 is equipped with its own grate 50 and a charging gate 51 for loose refuse. The purpose of these appurtenances in this one plenum is to provide an optional, alternative ignition source by burning loose light sort under the newly charged bale. A fire may be built upon grate 50 to start the furnace from a cold condition, charging of the loose light source being through port 51.

Blast gates 47 are shown which provide regulation of forced under-fire air from duct 48, with motive power provided by blower 49. Alternatively, the furnace may be maintained under negative pressure through operation of induced draft fan 50 with consequent omission of duct work 48; underfire combustion air in this case being regulated by blast gates 47 which regulate atmospheric air intake.

Overfire air for combustion of fuel-blocks/bales is provided through forced air fan 52 forcing atmospheric air into duct-conduit 53. Blast gates 54 are provided capable of regulating overfire air in proportion to combustion rate of fuel-blocks.

Alternatively, operation of the furnace under negative pressure may be desired in which case induced draft fan 50 will operate to draw atmospheric air through blast gates 54, in which case blower 52 with duct-conduit 53 are unnecessary.

Also, where operating the furnace under negative pressure, blower 55 serves to withdraw a fraction of hot products of combustion. The flow of this gas, regulated by valving 56, assists drying of "light sort" in trommel 6, FIG. 1.

The products of combustion exhaust the furnace at exit port 57 and pass into heat recovery and gas cleanup plant 58, for removal of particles and harmful vapor components such as halogens, using conventional systems and technology for both heat recovery and gas clean-up not detailed here, before exhausting to atmosphere via stack 59.

One charging door 60, in roof of furnace for noxious wastes, treatment plant sludges or heavy sort 7, FIG. 1, is shown as hinged. Others, not shown, may be included. Other closures, such as a sliding door, will be obvious, and their omission shall not be cause for detraction from patent coverage.

Figure 3:
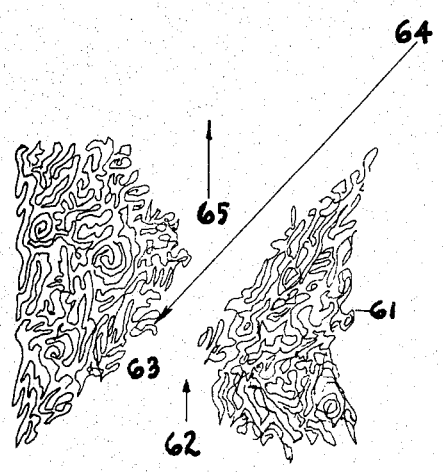
FIG. 3 is a schematic section of a small portion of baled light sort impacted by radiant energy.

Ignition of freshly charged bales in the furnace, when at operating temperatures, occurs through conduction heat transfer from a previously charged bale in combustion. Another source of ignition is by radiant energy as shown in FIG. 3 wherein the particles of "light sort" within the bale/fuel-block show deformation-set 61. Springback or the opening of voids within the bale/fuel-block is shown by lower channel 62, which for purposes of illustration necks down at a random spot 63, characterized by contamination with materials of lower ignition point. Spot 63 which represents a spot of grease or other highly combustible material (of lower ignition temperature than paper) is shown as in line of sight of radiation from high temperature source 64, of the sidewall or roof of the furnace. Hence, spot 63 ignites and starts combustion supported by oxygen from underfire air via channel 62; the products of pyrolysis and/or combustion making their way to the top surface of the bale/fuel block through channel (conduit) 65. It will be understood that said combustion at 63, which may be a good distance down from the top surface of the bale/fuel-block, takes place notwithstanding the fact that conduits 62 and 65 show sidewalls of intact "light sort". This will explain the perhaps surprising observation of fire appearing well within and throughout the mass of the bale at short times after charging bales to the furnace at operating temperatures.

Figure 3A:
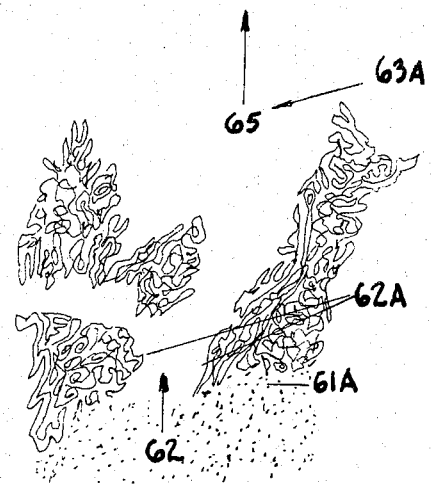
FIG. 3A is a schematic section through bale/fuel block while in combustion.

The course of sequence of combustion is shown in FIG. 3A which is a schematic cross-section of bale such as 40 of FIG. 2 wherein the top section may be as much as 12" thick above a lower section of like thickness. Lower channel 62 conducts underfire air into the bale in combustion, initially causing pyrolysis and char formation of sidewalls of the conduit, the char indicated as 62A. The gaseous pyrolysis products pass upwards, eventually through channel 65, meet overfire air 63A at the top surface, and there react with oxygen to release their heat of combustion at the top surface. Char, the second product of pyrolysis, following retention at the required high temperatures and at the necessary oxygen concentrations is oxidized to carbon dioxide, leaving only incombustible ash 61A.

Accordingly, it will be seen that the bale/fuel-block is consumed primarily from the bottom. The unconsumed portions of the bale falls, during the course of combustion, toward the grate, the ash, for its part occupying negligible volume.

Figure 5:
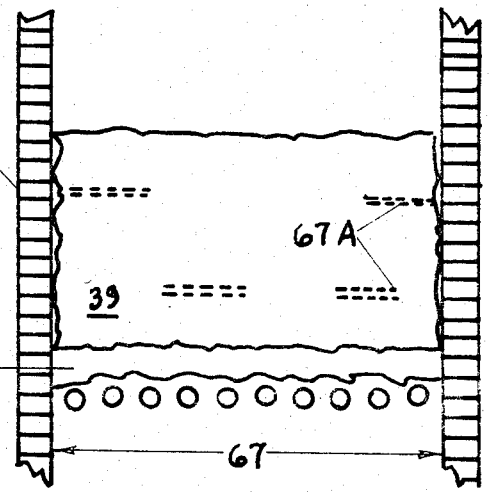
FIG. 5 is similar in conditions to FIG. 4 showing springback expansion of the bale some short interval after charging.

Referring to FIG. 4 there is shown vertical section of the lower part of the furnace viewed from the charging port, the refractory lined sidewalls 66 define furnace width, with grates 38 (FIG. 2) between sidewalls 66. Bale/fuel-block 39 (FIG. 2) is shown immediately as charged into the furnace. A measurable gap 68 extends from the sides of the bale/fuel-block to the inside surface of the refractory lined furnace walls 66. The dimension of one (of two) gaps 68 may be 5% to 15% of the width of the fuel-block/bale 39. The dimensioning of fuel-blocks/bales to be charged to the furnace anticipates the fact that gaps 68 are sealed off with "light sort", immediately after charging of bale/fuel-block to the furnace as shown in FIG. 5, in first measure due to springback of the bale and secondly due to thermal expansion. Springback is here used in the commonly accepted sense to indicate the increase in three linear dimensions of a bale of refuse, after release of compaction pressure, said increase occurring due to the fact that the compaction pressure employed was below the pressure required for permanent set or below the upper limit of the modulus of elasticity of the refuse.

The property of springback is illustrated when balling up a piece of paper in one's hand and noticing the expansion of the ball after releasing pressure.

This is further illustrated in FIG. 5 wherein the bale/fuel-block 38 (FIG. 2) is shown at width 67, the full inside wall to wall measurement of the furnace chamber, after springback and thermal expansion. Specification of bale/fuel-block width as formed, equalling inside width (inside refractory to inside refractory dimension of furnace sidewalls) after expansion due to springback and thermal expansion is to provide a seal between fuel-block/bale and refractory. This seal is required to prevent added sludges and/or noxious refuse from falling unincinerated to grates.

The charging of wet and noxious wastes to the furnace may be by many and varied means and devices, of which only one will be shown; the use of other devices is not to be construed detrimental to patent rights and coverage.

FIG. 6 shows in schematic fashion one method of charging noxious wastes together with a cross-section of the furnace taken parallel to charging port 36 of FIG. 1. Auxiliary equipment including a machine for removing heads of drums 71, drum lifting device 72, conveyor belt 73 conveying "light sort" 15 (FIG. 1), or alternately conveying "heavy sort" 7 (FIG. 1) are also shown. Item 74 is a commercial cement/concrete mixer with lifting flights which discharges into loading tray 75, equipped with hydraulic or mechanical means for advancing and retracting of tray 76 advance into furnace after loading occurring only after guillotine gate 77 is raised. In operation, liquid from incoming drum 70 is made accessible by removing head of drum on 71, lifting (if required) using lifting mechanism 72, upending drum 70 into cement/concrete mixer 74, which also receives a charge, equal to 25% to 200% of the weight of liquid in drum 70 of "light sort" or "heavy sort". The purpose of the admix of the solid waste to the liquid waste is absorption and dispersion/covering of the liquid upon the solids, a preliminary step to uniform distribution of the liquid waste on bales/fuel-blocks while in combustion in the furnace.

Figure 7:
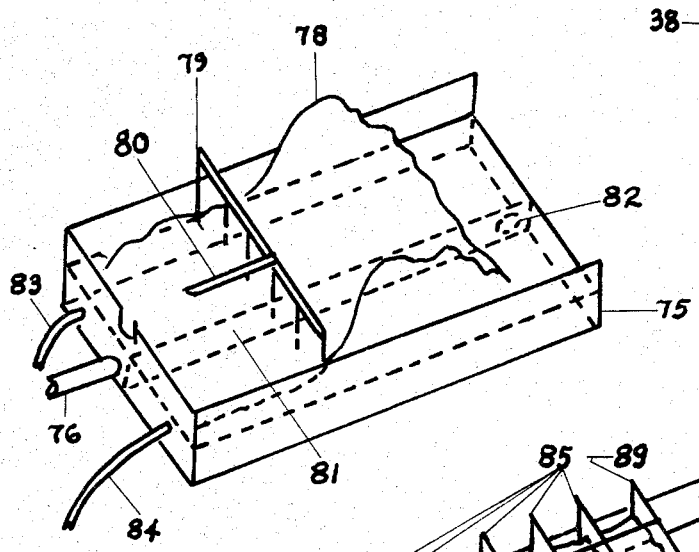
FIG. 7 shows the charging tray for noxious wastes as initially loaded.

A more detailed view of tray 75 is given in FIG. 7 wherein 78 designates the pile of "light" or "heavy" sort, coated with liquid waste after dumping by a rotary drum type of concrete mixer 74 (FIG. 6). By operation of rake 80, activated by hydraulic/mechanical drive (not shown) to advance and retract rake 80, the pile 78 is levelled out on the floor of tray 75. Waste loaded into tray 75 is limited to the area included between back plate 89 and front plate 90. This provides unobstructed floor space on tray 75 for loading of emptied or partially emptied drums 70. Tray 75 is equipped with a slidable, water cooled bottom, commonly called cooling water jacket which is longitudinally divided by a center plate 81, with hole 82 for passage of water. Cooling water is introduced to the jacket by way of flexible conduit 83 and discharged by way of flexible conduit 84. The purpose of cooling the bottom of tray 75 is protection against the approximately 3000° F. exposure while unloading the tray in the furnace.

Figure 8:
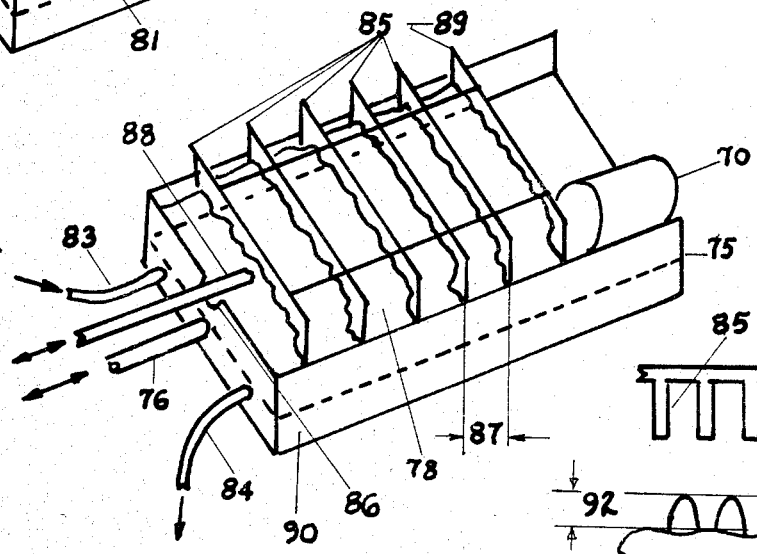
FIG. 8 is a schematic illustration of the loaded charging tray with hold-down rake, before charging to the furnace.

Further to uniform charging, reference is made to FIG. 8 showing lock rake 88 in position, resting on levelled, liquid coating refuse 78 of FIG. 7. The rake is free to rest on the refuse due to slot 86 in upper sidewall of tray 75. The spacing of rake bars 85 is from 5" to 12". Rake bar 88 is equipped with means for locking into forward/charging position, and for full retraction out of furnace 88A (FIG. 6).

Figure 9:
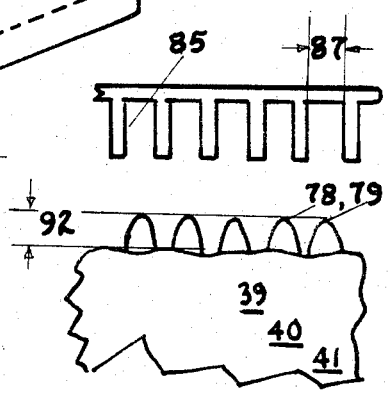
FIG. 9 is a schematic section showing the distribution of mixture of noxious waste and refuse as charged on burning bales.

In operation, tray 75 is loaded with liquid coated refuse 78, levelled on bottom of tray using rake 80 (FIG. 7) following which this rake is withdrawn. Lock rake 88 (FIG. 8) is lowered into tray 75, the weight of assembly 88 compressing the underlying coated waste. Both loaded tray 75 and lock rake 88 are advanced into furnace, guillotine charging door 77 (FIG. 6) having been previously opened for this purpose, and cooling water to bottom cooling water jacket being admitted using 83 in and 84 (FIG. 7) out. Both tray 75 and lock rate 88 are supported by a support (not shown) located outside of the furnace, by cantilever action, while in the furnace. These having reached the predetermined location within the furnace, lock rake 88 is locked into position and tray 75 is retracted to outside the furnace, the contents of the tray 78, falling to burning bales 39, 40 or 41, forming furrows 91 as shown in FIG. 9. Immediately thereafter, lock rake 88 is withdrawn to its parallel cold position to that of tray 75. It will be seen that the use of charging tray 75, levelling rake 80 (FIG. 7) and lock rake 88 (FIG. 8) will yield furrow coverage of liquid coated refuse on bales/fuel-blocks in combustion 91 as shown in FIG. 9, taken in plane parallel to charging gate.

It will be evident from FIG. 9 that the liquid coated solid waste 78 will be charged in parallel ridges and furrows 91 on top surfaces of bales/fuel-blocks 39, 40, 41 in furnace 88A (FIG. 6), of maximum height 92 proportional to spacing 87, of the bars 85 of lock rake 88 (FIG. 8).

The before given system for charging of noxious wastes shows flexibility in both the amount of noxious waste charged and of charge point within the inside area of the furnace. In that system reliance is placed on vapor phase oxidation, at about 3000° F., in pressure of both excess oxygen and water, with suitable detention time within the furnace system to achieve the 99.999% of noxious wastes destruction as required by statute.

Alternate noxious waste charging methods include compressing the mixed mass 78 (FIG. 6) into bales before charging on top of bales of "light sort".

Alternately, part of the noxious waste may be mixed with "light sort" 15, before formation of bales/fuel-blocks. The two last named alternate charging methods demonstrate longer vapor path lengths at temperature and thereby increase the factor of safety respecting completeness of combustion.

Figure 10:
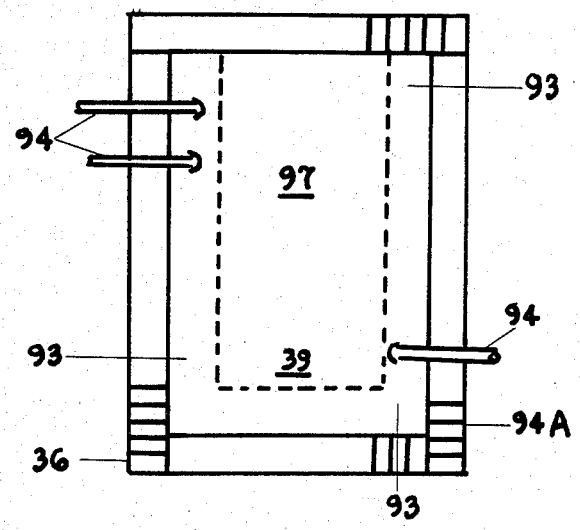
FIG. 10 is a plan view of the furnace taken immediately above fire showing perimeter zone receiving liquid water for cooling.

FIG. 10 is representative of cross-section of the furnace at coated liquid or liquid charging level, approximately 12" to 24" above top surface of a newly charged bale/fuel-block 39. Orientation is provided through charging gate 36. A perimeter band inside three walls of the furnace 93 is optionally not used for incineration of liquids or liquid coated waste but rather is reserved for receiving liquid water. Provisions for adding liquid water is shown as pipes penetrating sidewalls with downward looking nozzles 94.

The purpose of this will be made clear by reference to FIG. 11, cross-sectional elevation of furnace in a plane parallel to charging port. With water or sewage sludges sprayed on the fuel-blocks/bales while in combustion through pipe-nozzles 94, a reduced temperature steam-enriched gaseous product of combustion 93 for illustrative purposes assumed to be 1250° F. at level 93A, 6" to 12" above top furnace of bale/fuel block in combustion, is attained following balanced matching of liquid water addition to heat release rate within zone 93. In a typical furnace, zone 93 extends inward for about 2 to 4 feet from the furnace wall and extends adjacent three sides of the furnace wall. The interior zone 97 for its part is at temperature somewhat in excess of 3000° F. when the furnace is charged with compacted "light sort" showing an average of 20% moisture, and with combustion controlled at 10% excess air. Temperatures of 2400° F. and possibly higher are required by statute for incineration of specific classes of noxious wastes, and is well satisfied by the greater than 3000° F. here reached in the space designated 97. In following the path of the steam plus products of combustion mixture generated in perimeter band 93, an initial temperature of 1250° F. at level 93A is assumed. This gas will rise guided by furnace sidewalls and arch, and in rising will be heated from the assumed 1250° F. to an assumed 1400° F. to 1500° F. by convection and radiation from the gaseous products of combustion also rising from the center section 97, which at 10% excess air, and with temperature correction for radiation to the cooler gasses at sidewalls and the cooling effect of the noxious liquids added in section 97, may be assumed to fall in the range 2600° F. to 2900° F. at springline of arch 95. By proportioning the pounds per minute of each of these two gaseous streams, a temperature after mixing of 1600° F. to 1700° F., compatible with commercially available and economical refractory lining at apex of the arch, 96 will be attained. The overall result of zoning of the fire-bed with outer perimeter receiving liquid water, inside area receiving the noxious liquid for incineration is attainment of statutory high temperature requirements while maintaining the refractory lining at lower temperatures required for economical costs in both construction and maintenance. Path length for gaseous oxidation reactions of noxious wastes at elevated temperatures is fixed by height, 98, and point of addition of noxious wastes, 39, 40, 41, or 42, FIG. 2.

A bale is defined as a compacted mass of trash which was compacted under a pressure of at least ten pounds per square inch and has a volume of at least ten cubic feet. A bail, as herein defined, need not be bound by holding means, such as a strap, if it sufficiently maintains its shape and size to perform the functions described above.

Another advantage of liquid water addition to the furnace in mass solid waste incineration service, as here outlined, is the 35% reduction in flue gas volume, and hence in size of gas cleanup (electrostatic precipitator, high pressure drop venturi wet scrubbing or other system when compared to the commonly employed excess air system for regulating furnace offgas temperatures.

Exhaust hot combustion gasses from the furnace exit through port 57 (FIG. 2) into the exhaust gas cleanup system with optional heat recovery 58 (FIG. 2), which is conventional design and will not be here detailed. After cleanup to Codes, the gas may be pressured by fan 50 (FIG. 2) into stack 59 (FIG. 2) for discharge to atmosphere.

Figure 11:
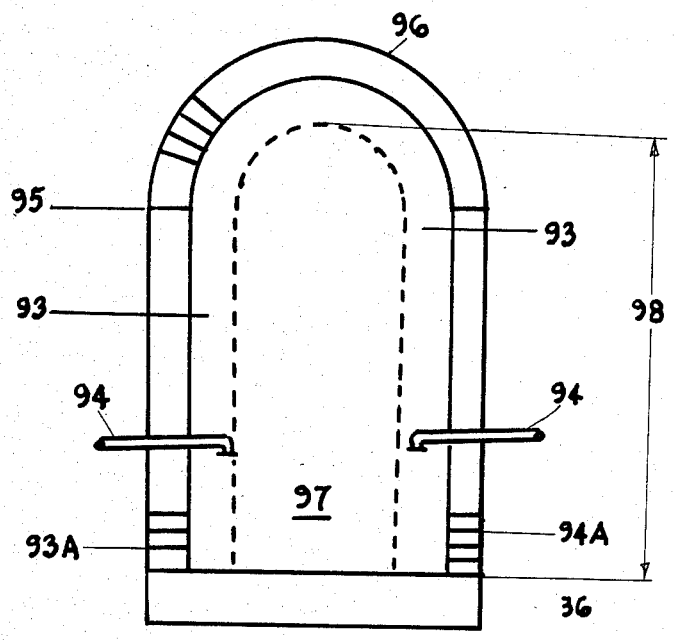
FIG. 11 is a schematic cross-section of furnace parallel to face of charging ram showing roof-arch arrangement conducive to mixing of cool perimeter gasses with hotter interior gaseous products of combustion.

The furnace of FIGS. 10 and 11 is similar to the furnace described in connection with FIGS. 1 and 2 in the following respects: The furnace of FIGS. 10 and 11 has all of the fuel input means from inlet 15 to and inclusive of gate 36 (see FIG. 1) for feeding bales of trash into the furnace. Similarly, FIGS. 10 and 11 have plenums 49 and 33 as shown in FIG. 2. Similarly, the inner side walls of FIG. 11 are spaced apart slightly more than the transverse dimension of the bales of trash; and the methods and apparatus for feeding bales of trash into, and burning the bales in, the furnace of FIGS. 10 and 11 is the same as in FIGS. 1 and 2. Moreover, the exhaust system of FIGS. 10 and 11 is the same as for FIG. 2 including the hot gas return pipe 11 (FIGS. 1 and 2), to feed hot gas into the trash classifying system 6, 14, 13, 18, 15, 23, etc. Similarly, the system of grates, etc., is the same for FIGS. 10 and 11 as for FIG. 1, etc.

I claim:

1. A method of burning trash that is a mixture of light sort and heavy sort, and largely composed of burnable materials of random size, comprising:

separating the light sort from the heavy sort, compressing the light sort that has been separated from the heavy sort, under a pressure of at least ten pounds per square inch into individual bales that weigh at least ten pounds per cubic foot and have a size at least as large as ten cubic feet, providing a furnace having a temperature inside the furnace of at least 1400° F., feeding the individual bales into the furnace, one after another, at a rate such that the burnable trash is burned, separating at least some of the compacted materials from each other, to allow burning of the separated materials to begin, and applying air under pressure to the bales to facilitate combustion thereof.

2. The method of destroying noxious wastes comprising:

providing a furnace, compacting trash under a compacting pressure of at least ten pounds per square inch into bales of at least ten cubic feet each, inserting the bales of trash into the furnace, burning the bales of trash in the furnace to provide temperatures in the center of the combination area of at least 1400° F. and high enough to destroy the noxious wastes, feeding the noxious wastes into a combustion area which has achieved a temperature high enough to destroy the noxious wastes, and adding liquid water above outer portions of the burning bales to reduce the temperature around at least part of the periphery of the burning bales; the temperature near the middle of the combustion area above the bales reaching temperatures high enough to destroy the noxious wastes fed thereto.

3. The method of claim 2 in which the bales are fed into a furnace of the type having refractory sidewalls; the liquid water being fed above the burning bales and adjacent said sidewalls to thus reduce the temperature, to which the sidewalls are heated, to a level low enough that the refractory material is not injured thereby.

4. The method of destroying noxious wastes comprising:

providing a furnace, compacting trash under a compacting pressure of at least ten pounds per square inch into bales of at least ten cubic feet each, inserting the bales of trash into the furnace, burning the bales of trash in the furnace to provide temperatures in the center of the combination area of at least 1400° F. and high energy to destroy the noxious wastes, and, feeding the noxious wastes into a combustion area which has achieved a temperature high enough to destroy the noxious wastes, said noxious wastes comprising liquid wastes which are mixed with "light sort" trash before being fed into the furnace.

5. The method of destroying noxious wastes comprising:

providing a furnace, compacting trash under a compacting pressure of at least ten pounds per square inch into bales of at least ten cubic feet each, inserting the bales of trash into the furnace, burning the bales of trash in the furnace to provide temperatures in the center of the combination area of at least 1400° F. and high enough to destroy the noxious wastes, and feeding the noxious wastes into a combustion area which has achieved a temperature high enough to destroy the noxious wastes, comprising the steps of (a) feeding the noxious wastes into a tray, (b) and in which said tray with the wastes therein are moved into the furnace, (c) following which the noxious wastes are emptied from the tray onto a portion of the burning bales which is at a sufficiently high temperature as to destroy the noxious wastes.

6. The method of claim 5 in which the noxious wastes are mixed with "light sort" before the tray enters the furnace.

7. The method of destroying noxious wastes comprising:

providing a furnace, compacting trash under a compacting pressure of at least ten pounds per square inch into bales of at least ten cubic feet each, inserting the bales of trash into the furnace, burning the bales of trash in the furnace to provide temperatures in the center of the combination area of at least 1400° F. and high enough to destroy the noxious wastes, and feeding the noxious wastes into a combustion area which has achieved a temperature high enough to destroy the noxious wastes, comprising:

(a) providing a tray for holding said mixture, (b) providing a rake, (c) raking the contents of the tray with said rake to tend to render said mixture in the tray level, and (d) charging the furnace by placing the contents of said tray into said combustion area.

8. The method of claim 7 which also includes the step of placing a lock rake in said tray after said contents have been raked.

9. The method of destroying wastes that can be destroyed only at temperatures so high that refractory sidewalls of a furnace would be injured by such temperatures, comprising:

providing a furnace with refractory sidewalls, compacting trash under a compacting pressure of at least ten pounds per square inch into bales of at least ten cubic feet each, inserting said bales into said furnace, burning the bales, and adding liquid water above the burning bales and adjacent at least some of said sidewalls to keep the temperature of said sidewalls sufficiently low so that said refractory sidewalls will not be injured by the heat from the burning bales, the temperature in the central combustion area rising to a temperature of at least 1400° F. and so high that it will destroy wastes that can be destroyed only at temperatures so high that refractory sidewalls of the furnace would be injured by such temperatures, and adding to said central combustion area wastes that can be destroyed only at temperatures which are so high as to injure said refractory sidewalls.

10. The method of burning trash as defined in claim 9 in which the step of providing a furnace comprises providing a furnace with an elongated stationary grate.

11. A method of burning trash comprising:

compacting the trash, under a pressure of at least ten pounds per square inch, into bales with individual bales having a size of at least ten cubic feet, providing a furnace having an elongated grate to provide a path along which said bales may move while they burn and for supporting the bales while they burn, moving said bales along said path, in series, with each bale following the preceding bales, burning said bales while they are positioned along said path, to produce a temperature above the bales of at least 1400° F., said bales being moved along said path at a rate which substantially completely burns a bale after it has traveled at least a given distance along said path, and feeding combustion air under pressure through said grate with the amount of pressure varying along said path;

providing a series of plenums under said grate for feeding said combustion air to bales moving along said path, the air pressures in said plenums decreasing from plenum to plenum with the maximum pressure being in the plenum which feeds air to the new bales entering the furnace.

12. A method of burning trash largely composed of burnable materials of random size, comprising:

compressing the trash under a pressure of at least ten pounds per square inch into individual bales that weigh at least ten pounds per cubic foot and have a size at least as large as ten cubic feet, applying holding means to the bales to hold the compressed trash in the form of individual bales, providing a furnace having a temperature inside the furnace of at least 1400° F., feeding the individual bales into the furnace, one after another, at a rate such that the burnable trash is burned, removing the holding means and separating at least some of the compacted materials from each other, to allow burning of the separated materials to begin, and applying air under pressure to the bales to facilitate combustion thereof.

13. A method of burning trash in a furnace comprising:

feeding air into the trash to blow the light trash away from the heavy trash; and thereby sort the trash into light trash and heavy trash, compacting, with a pressure of at least ten pounds per square inch, the light trash, resulting from said sorting step, into bales, with each bale having a size of at least ten cubic feet, feeding said bales, one after another, into the furnace and burning the bales in the furnace, and feeding the heavy trash, resulting from said sorting step, onto the top of at least one of said burning bales.

14. The method of burning trash in a furnace as defined in claim 13 in which said step of feeding air into the trash comprises feeding heated air, including some of the exhaust gases from the furnace, into the trash to not only blow the light trash away from the heavy trash, but to also remove moisture from the trash.

15. A method of burning trash in a furnace comprising:

feeding air, that is below 500° F. and at least some of which comprises hot exhaust gases from the furnace, into the trash to blow the light trash away from the heavy trash, and thereby sort the trash into light trash and heavy trash, compacting, with a pressure of at least ten pounds per square inch, the light trash, resulting from said sorting step, into bales, with individual bales having a size of at least ten cubic feet, feeding said bales into the furnace, and burning the bales that are fed into the furnace to provide said hot exhaust gases.

16. The method of using a ram movable toward and away from the opening in a furnace for charging said furnace with bales of trash and then burning the trash comprising:

(a) blocking the opening in said furnace, (b) feeding trash into the space between the ram and the blocked opening to the furnace, (c) moving the ram toward said blocked opening to compact the trash under a compacting pressure of at least ten pounds per square inch, (d) withdrawing the ram from said blocked opening, (e) feeding more trash between the ram and the previously compacted trash, (f) again moving the ram toward said blocked opening to compact the trash, under said compacting pressure of ten pounds per square inch, that was added by step (e), (g) repeating steps (d), (e) and (f) one or more times to form a bale of trash of a size of at least ten cubic feet, (h) unblocking said opening, (i) utilizing said ram to push said bale of trash into the furnace, and (j) burning the bale of trash in the furnace, producing a furnace temperature of at least 1400° F.

17. The method of claim 16 in which the trash fed between the ram and the blocked opening is light trash and in which the ram compacts the light trash to such density that one cubic foot of the compacted trash weighs between 10 and 20 pounds.

18. The method of burning trash in a furnace of the type which has a supporting area in the furnace and on which the trash may be burned, said supporting area having openings to allow combustion air to enter and ashes to fall through, comprising:

(a) compacting the trash into bales, (b) applying force to a first bale to push it onto said supporting area, (c) applying a force to a second bale to cause it to push the remains of the first bale along said supporting area while the remains of the first bale are being burned, and, (d) providing air for combustion through said supporting area to the bales being burned, (e) the step of compacting said trash into bales comprising compacting them in one of their dimensions so that each bale, in the dimension, is slightly smaller than the space between said guides, (f) applying holding means to each bale to maintain the bale compacted, in said dimension, and limit the size of the bale so that its said dimension is less than the distance between said guides, (g) inserting the bales one after another between said guides, with each bale applying the sole force for moving the immediately preceding bale or remains thereof along said supporting area, and with said dimension being generally horizontal and perpendicular to the path of travel of the bales, (h) the step of moving the bales along said supporting area comprising moving the bales generally horizontally along said supporting area, and (i) deactivating the holding means on each bale, after the bale is between said guides so that the bale will expand, along said dimension, and fully extend from one of said guides to the other, before it is burned.

19. The method of burning trash in a furnace of the type which has a supporting area in the furnace and on which the trash may be burned, said supporting area having openings to allow combustion air to enter and ashes to fall through, said furnace having a channel with spaced guides extended generally upward with said supporting area extending between said guides, comprising:

(a) compacting the trash into bales, (b) applying force to a first bale to push it onto said supporting area, (c) applying a force to a second bale to cause it to push the remains of the first bale along said supporting area while the remains of the first bale are being burned, and, (d) providing air for combustion through said supporting area to the bales being burned, (e) the step of compacting said trash into bales comprising compacting them in one dimension so that each bale, in that dimension, is slightly smaller than the space between said guides, (f) providing a strap of a type that will melt below the temperature in the furnace; and applying the strap to each bale to maintain the bale compacted, in said dimension, to thereby limit the size of the bale so that its said dimension is less than the distance between said guides, (g) the strap on each bale melting under heat of the furnace, after the bale is between said guides, so that the bale will expand, along said dimension, and fully extend from one of said guides to the other, to facilitate burning of the bale, and (h) allowing the bale to remain in the furnace and exposed to the heat thereof until the bale is reduced to ash, at least in part, by pyrolysis.

20. In a furnace for burning bales of trash:

a furnace having first grate means for supporting bales of trash and for allowing combustion air to flow upward to said bales, said furnace having an opening through which bales of trash may be inserted and thereby fed onto said first grate means, means for baling the trash and feeding the bales into the furnace, through said opening, one after another, and along said first grate means, a series of plenums under said first grate means for guiding air upwardly through said first grate means and to said bales, the plenum which is closest to said opening including (a) a second grate means which is below said first grate means and (b) an access hole, located between said first and second grates, permitting burnable material to be placed on said second grate; whereby the burning of said bales may be started by starting a fire on said second grate.

21. Apparatus for burning bales of trash comprising:

a furnace, a trommell, for receiving the unbaled trash and having holes in its sidewalls to permit heavy trash to fall through said holes, means for feeding air through said trommell to blow the light trash away from the heavy trash and thereby separate the light trash from the heavy trash, means for baling the light trash which was separated from the heavy trash, and means for feeding said bales into said furnace.

22. The method of burning a bale of trash in a furnace of the type having a supply of combustion air flowing vertically upward, comprising:

compacting loose trash into a bale with a compacting pressure of at least ten pounds per square inch, with the resulting bale having a size of at least ten cubic feet, applying holding means to the bale to hold the compacted trash in the form of a bale, orienting the bale to a first orientation so that when it is fed into the furnace and is burning that the trash in the bale offers less air pressure drop through the bale than would be the case with any orientation other that said first one, feeding the bale into the furnace with said first orientation, removing the holding means, and burning the bale to produce a temperature in the furnace of at least 1400° F.

23. The method of burning bales of trash in a furnace having grate means on which the bales of trash may burn, comprising:

placing ferrous scrap along the top of said grate means, baling the trash with a compacting pressure of at least ten pounds per square inch producing bales of a size of at least ten cubic feet, and feeding the resulting bales onto said ferrous scrap that is on said grate means, and burning the bales on said ferrous scrap to produce a temperature in the furnace of at least 1400° F.

24. The method of burning trash in a furnace of the type which has a supporting area in the furnace and on which the trash may be burned, said supporting area having openings to allow combustion air to enter and ashes to fall through, comprising:

(a) compacting the trash into bales, (b) applying force to a first bale to push it onto said supporting area, (c) applying a force to a second bale to cause it to push the remains of the first bale along said supporting area while the remains of the first bale are being burned, and (d) providing air for combustion through said supporting area to the bales being burned, (e) said compacting step including providing a binding strap having a melting point below the temperature in the furnace and binding the bale with the strap so that the bale will remain compacted as it enters the furnace; so that the strap upon entering the furnace will melt, allow the bale to expand, and thereby facilitate burning of the bale.

25. The method of burning trash in a furnace of the type which has a supporting area in the furnace and on which the trash may be burned, said supporting area having openings to allow combustion air to enter and ashes to fall through, comprising:

(a) compacting the trash into bales, (b) applying force to a first bale to push it onto said supporting area, (c) applying a force to a second bale to cause it to push the remains of the first bale along said supporting area while the remains of the first bale are being burned, and, (d) providing air for combustion through said supporting area to the bales being burned, the improvement wherein:

each bale is bound by a meltable strap before it enters said elongated supporting area, and melting the strap by the time that the bale reaches a position in the furnace where it will burn.

26. The method of burning trash in a furnace of the type which has a supporting area in the furnace and on which the trash may be burned, said supporting area having openings to allow combustion air to enter and ashes to fall through, comprising:

(a) compacting the trash into bales, (b) applying force to a first bale to push it onto said supporting area, (c) applying a force to a second bale to cause it to push the remains of the first bale along said supporting area while the remains of the first bale are being burned, and, (d) providing air for combustion through said supporting area to the bales being burned, and, (e) binding each bale with a meltable strap before it is pushed onto said supporting area, to enable the strap to melt due to heat of the furnace before the bale is burned, and guiding each bale along said supporting area as burning proceeds.

27. The method of burning trash in a furnace of the type which has a supporting area in the furnace and on which the trash may be burned, said supporting area having openings to allow combustion air to enter and ashes to fall through, the furnace having a heated portion, comprising:

(a) compacting the trash into bales, (b) applying force to a first bale to push it onto said supporting area, (c) applying a force to a second bale to cause it to push the remains of the first bale along said supporting area while the remains of the first bale are being burned, and, (d) providing air for combustion through said supporting area to the bales being burned, (e) igniting the bales of trash by heat radiated from said heated portion, and (f) providing a meltable strap which binds the compacted bale to a limited size, and in which the strap is melted by the heat of the furnace as it enters the furnace so that the bale is expanded at the time it receives said radiated heat, whereby the radiated heat may enter the interstices between bits of trash comprising the bale and ignite the trash, and guiding the bales along said supporting area while they are burning.

28. The method of burning a bale of trash in a furnace of the type having a supply of combustion air flowing vertically upward, comprising:

providing trash comprising a mixture of light sort and heavy sort, separating the light sort from the heavy sort, compacting the light sort that has been separated from the heavy sort, into a bale with a compacting pressure of at least ten pounds per square inch, with the resulting bale having a size of at least ten cubic feet, orienting the bale to a first orientation so that when it is fed into the furnace and is burning that the trash in the bale offers less air pressure drop through the bale than would be the case with any orientation other that said first one, feeding the bale into the furnace with said first orientation, and burning the bale to produce a temperature in the furnace of at least 1400° F.

* * * * *